United States Patent [19]

De Bortoli et al.

[11] Patent Number: 5,001,817

[45] Date of Patent: Mar. 26, 1991

[54] SECURING AND ADJUSTMENT DEVICE PARTICULARLY FOR SKI BOOTS

[75] Inventors: Giuseppe De Bortoli, Montebelluna; Claudio Zorzi, Silea, both of Italy

[73] Assignee: Nordica S.p.A., Montebelluna, Italy

[21] Appl. No.: 537,733

[22] Filed: Jun. 14, 1990

[30] Foreign Application Priority Data

Jun. 22, 1989 [IT] Italy ..... 82557 A/89

[51] Int. Cl.[5] ..... A43C 11/00

[52] U.S. Cl. ..... 24/68 SK; 24/68 B; 24/71.2

[58] Field of Search ..... 24/68 SK, 68 B, 69 SK, 24/70 SK, 71 SK, 71.2, 498; 36/50, 117

[56] References Cited

U.S. PATENT DOCUMENTS 1,467,943 9/1923 Lampert ..... 24/71.2
3,729,779 5/1973 Porth ..... 24/68 SK
3,834,048 9/1974 Maurer ..... 24/68 SK
4,433,456 2/1984 Baggio ..... 24/68 SK
4,719,710 1/1988 Pozzobon ..... 24/68 B

*Primary Examiner*—Victor N. Sakran
*Attorney, Agent, or Firm*—Guido Modiano; Albert Josif

[57] ABSTRACT

A securing and adjustment device, particularly for ski boots, includes a case having a knob which can be actuated by the skier, and at least one spool, provided with an axial toothing, for winding at least one cable. The device further includes a resilient planar element which is associated, at one end, with the case and is arranged on a plane which is approximately parallel to the plane of arrangement of the axial toothing. The planar element has an angled wing which ratchet-like engages the axial toothing of the winding spool. A release means, such as an axially arranged button, is furthermore provided on the knob and interacts with the planar element so as to disengage its wing from the axial toothing of the spool.

7 Claims, 2 Drawing Sheets

SECURING AND ADJUSTMENT DEVICE PARTICULARLY FOR SKI BOOTS

BACKGROUND OF THE INVENTION

The present invention relates to a securing and adjustment device particularly usable in ski boots.

Several devices are known for securing one or more cables and having a knob to wind the cables at adapted winders or pulleys.

For this purpose, the same Assignee filed, on Jan. 18, 1982, a U.S. Pat. application Ser. No. 06/340.549, granted on 28.2.1984 No. 4,433,456 disclosing a device which comprises a case body provided with a knob for the actuation of a spool for winding at least one cable.

The device further has a pawl which is provided at one end with an axial seat for a pivot for pivoting to the case and has a tooth which engages ratchet-like with a set of teeth of the spool, said tooth being forced toward said spool by means of a spring conveniently fit within the case.

The above described device effectively secures and adjusts the cables, however it has the disadvantage of being of a relatively complicated structure and assembling.

The U.S. Pat. No. 3,834,048 and the German Patent No. DE-2.341.658, disclose winders having a simplified structure.

In these winders, though, the cable is not properly wound because it axially oscillates during its rotation owing to the interaction of its axial toothing with a fixed tooth or catch.

SUMMARY OF THE INVENTION

The aim of the present invention is to provide a securing and adjustment device of a simple structure and assembling and having an improved winding operation with respect to the prior art devices.

Within the above aim, an important object is to provide a device which associates with the preceding characteristics that of having modest production costs.

Not least object is to provide a device which is reliable and safe in use as well as easily operated by the skier.

This aim, and these and other objects which will become apparent hereinafter are achieved by a securing and adjustment device, particularly for ski boots, comprising a case body, a knob and at least one spool, said knob being actuated by a skier for rotating said spool associated with said case, said spool being adapted to wind at least one cable and comprising releasable means for preventing a rotation of said spool in an unwinding direction, characterized in that said releasable means comprises a resilient member adapted to engage an axial toothing formed on said spool, said resilient member comprising a substantially planar element having a loop fastened to said case and at least one angled wing adapted to engage said toothing.

BRIEF DESCRIPTION OF THE DRAWINGS

Further characteristics and advantages of the invention will become apparent from the detailed description of a particular but not exclusive embodiment illustrated only by way of non-limitative example in the accompanying drawings wherein.

DESCRIPTION OF THE PREFERRED EMBODIMENT

Figure 5:
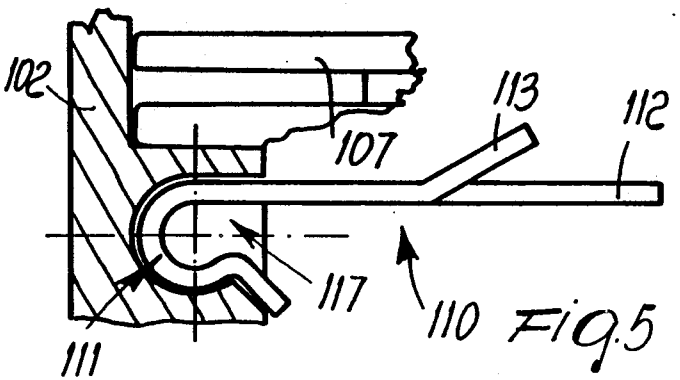
FIG. 5 is an enlarged detail sectional view similar to that of FIG. 1, of the arrangement of the resilient element of FIG. 4.

With reference to FIGS. 1-5, the reference numeral 1 indicates the securing and adjustment device, particularly usable for ski boots, which is constituted by a case member 2 associable with a section of the boot.

A knob 3 is rotatably associated with the case 2; said knob has an axial seat 4 and is provided with a first stem 5 which is keyed at an adapted tab 6 which protrudes from a spool 7 adapted to wind at least one cable 8 arranged inside the case 2.

The spool 7 has an axial toothing, or serration, 9 in the shape of a circular crown on the side opposite to the tab 6.

The device comprises a substantially planar resilient element 10 which is advantageously constituted by a sheet having a loop 11, at one end, which can be accommodated at, and rigidly coupled to, an adapted seat provided laterally to said case 2 below the spool 7.

The planar element 10 is furthermore arranged at a plane which is parallel to the plane of arrangement of the toothing 9.

A wing 13 is defined proximate to the free end 12 of the planar element 10, protrudes toward the spool 7 and interacts ratchet like with the toothing, or serration, 9 thereof.

A release means for the element 10, such as a button 14 is slidably associated at the axial seat 4 of the knob 3; said button 14 has a second stem 15 which passes at an adapted hole 16 defined on the spool 7 and interacts with the free end 12 of the planar element 10.

The operation of the device is therefore as follows: when the skier turns the knob 3 in the direction of winding of the cable 8, the planar element 10 allows the one-way rotation of the spool by virtue of the ratchet-like interaction of the wing 13 with the toothing 9 of said spool 7.

This is obtained by virtue of the elastic deformation of said planar element 10.

In order to release the cable it is sufficient for the skier to press the button 14 within the axial seat 4 provided on the knob 3; in this manner the second stem 15 of said button bends the free end 12 of the planar element 10, disengaging the wing 13 from the toothing 9 of the spool 7.

The latter is therefore free to rotate, allowing the unwinding of the cable.

Once the button has been released, the resiliency of the planar element 10 returns the wing 13 to interact with the toothing 9 so as to again allow the winding of the cable.

An advantage of the above described device is that the pivoting pin and the return spring required for the operation of the pawl are combined into a single member constituted by the planar element 10.

Figure 4:
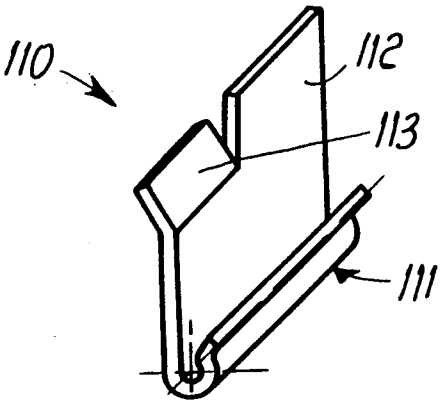
FIG. 4 is a view, similar to that of FIG. 3, of a different embodiment of the resilient planar element.
Figure 3:
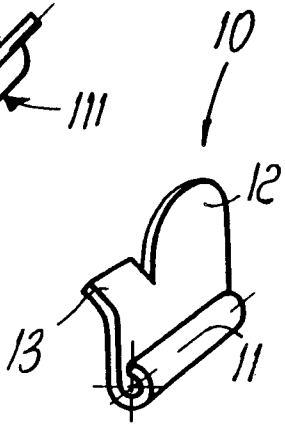
FIG. 3 is a detail isometric view of the resilient planar element of the device of FIG. 1.
Figure 1:
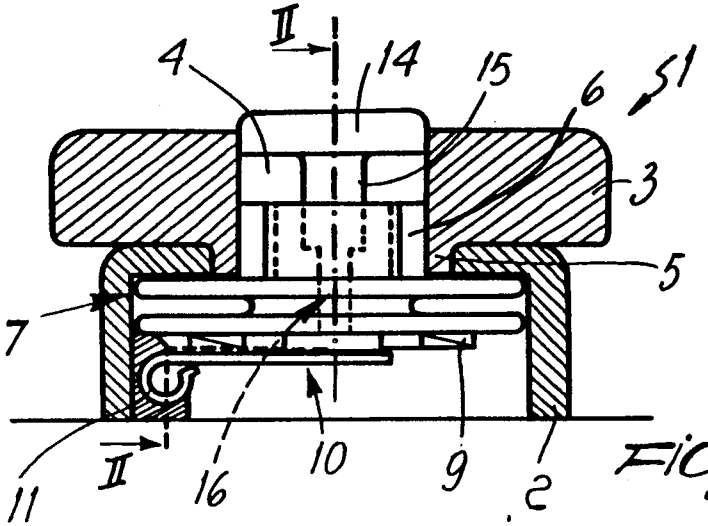
FIG. 1 is a sectional front view of the device according to a longitudinal sectional plane.
Figure 2:
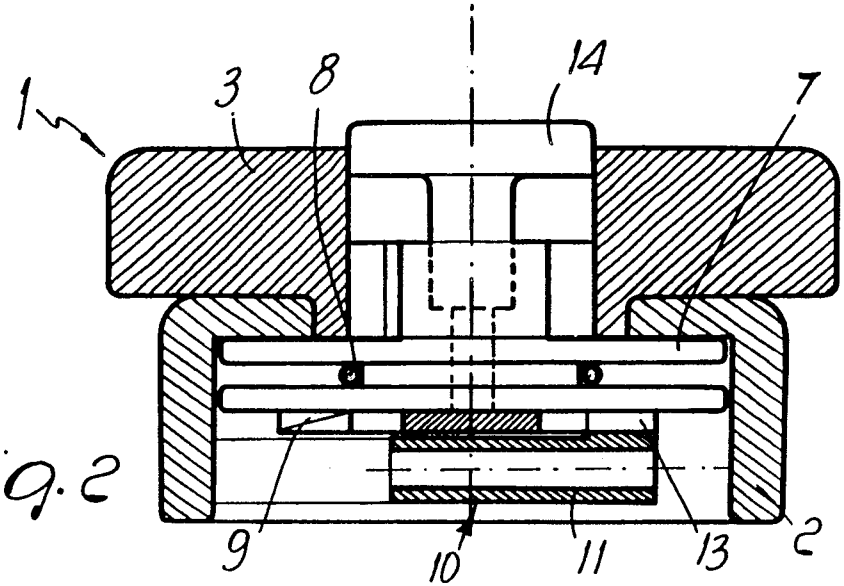
FIG. 2 is a sectional side view taken along the sectional plane II—II of FIG. 1.

FIGS. 4 and 5 illustrate a different embodiment of the planar element 110 which again has, proximate to the free end 112, a wing 113 which interacts with the front set of teeth of the spool 107.

On the opposite side with respect to the free end 112, the planar element 110 again has a loop 111 which however has an open configuration and can be accommodated in an adapted seat 117 defined at a side of the case 102.

This embodiment of the planar element further reduces the number of components of the device by eliminating the necessity of a fastening member for the planar element.

Figure 6:
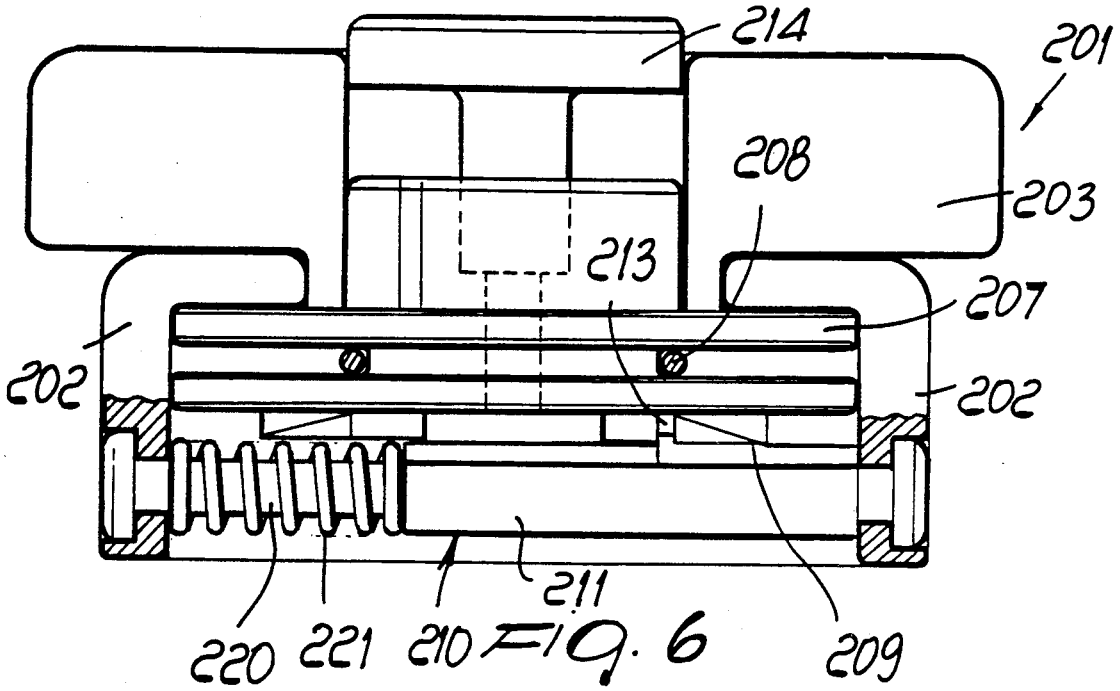
FIG. 6 is a sectional front view, similar to that of FIG. 1, of a device according to a second aspect of the invention.
Figure 7:
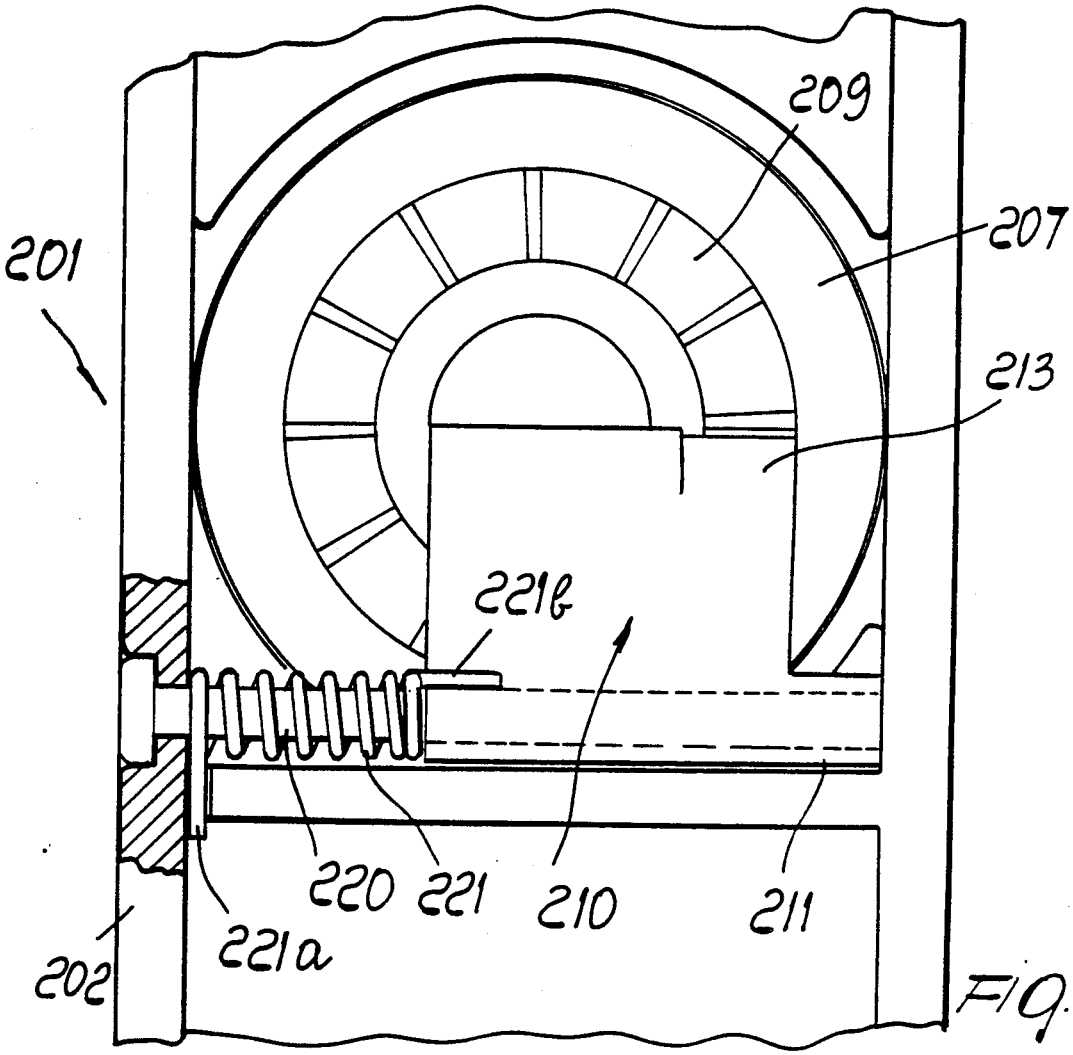
FIG. 7 is a sectional bottom view of the device of FIG. 6.

FIGS. 6–7 illustrate a device 201, according to a further aspect of the invention, comprising a case 202 for a spool 207 adapted to wind a cable 208, substantially as in the previously described device 1.

The spool 207 is actuated by a knob 206 which has a push-button 214 adapted to engage a planar element 210, which is in turn adapted to engage an axial toothing or serration 209, formed on the spool 207, substantially as previously described.

The planar element 210 has a loop 211 embracing a pivot 220 adapted to pivotally secure the planar element 210 to the case 202.

A spring 221 is coaxially arranged at the pivot 220 and has a first end 221*a*, fastened to the case 202, and a second end 221*b* connected to said planar element 210 and biasing the wing 213 against the axial toothing 209 of the spool 207.

To this purpose, the planar element 210 comprises an angled wing 213 adapted to ratchet-like engage the toothing 209, substantially as previously described.

The operation of the device 201 is identical to the operation of the previously illustrated embodiment.

The materials and dimensions which constitute the individual components of the device may also naturally be the most pertinent according to the specific requirements

We claim:

1. Securing and adjustment device, particularly for ski boots, comprising a case body a knob and at least one spool, said knob being actuated by a skier for rotating said spool associated with said case, said spool being adapted to wind at least one cable and comprising releasable means for preventing a rotation of said spool in an unwinding direction, said releasable means comprising a resilient member adapted to engage an axial toothing formed on said spool, said resilient member comprising a substantially planar element having a loop fastened to said case and at least one angled wing adapted to engage said toothing.

2. Device according to claim 1, wherein said knob is rotatably associated with said case and has an axial seat and a first stem which is keyed at an adapted tab which protrudes from said at least one winding spool arranged inside said case, said spool having, on the opposite side with respect to said tab, said axial toothing.

3. Device according to claim 1, wherein said releasable means comprises a push-button arranged at said axial seat formed in said knob, said button having a second stem adapted to slide in a hole formed in said spool, said second stem being adapted to interact with said planar element to disengage said wing from said toothing when said push-button is depressed.

4. Device according to claim 1 wherein said substantially planar element is arranged along a plane which is parallel to the plane of arrangement of said axial toothing.

5. Device, according to claim 3, wherein said loop of said planar element is fastened to an adapted seat provided at a side of said case, said wing being disengaged from said toothing by elastic deformation of said planar element upon actuation of said push button.

6. Device, according to claim 3, wherein said loop is rotatably associated with a pivot, said pivot being fastened to said case, a spring being associated with said pivot and having a first end secured to said case and a second end connected to said planar element and adapted to bias said wing to engage said toothing, said wing being disengaged from said toothing by elastic deformation of said spring, upon actuation of said push-button.

7. Device, according to claim 1, wherein said loop is open.

* * * * *